US006469251B1

(12) United States Patent
Dupuis

(10) Patent No.: US 6,469,251 B1
(45) Date of Patent: Oct. 22, 2002

(54) VAPOR PROOF HIGH SPEED COMMUNICATIONS CABLE AND METHOD OF MANUFACTURING THE SAME

(75) Inventor: Marc Raymond Dupuis, Danielson, CT (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/571,652

(22) Filed: May 15, 2000

(51) Int. Cl.[7] ..... H01B 7/00

(52) U.S. Cl. ..... 174/113 R; 174/113 C; 174/116

(58) Field of Search ..... 174/36, 110 R, 174/113 R, 113 C, 116, 110 PM, 110 FC, 110 F

(56) References Cited

U.S. PATENT DOCUMENTS

| | | | | |
|---|---|---|---|---|
| 2,119,393 A | * | 5/1938 | Lewis et al. | 173/264 |
| 3,610,814 A | * | 10/1971 | Peacock | 174/23 |
| 3,643,007 A | | 2/1972 | Roberts et al. | 174/106 |
| 3,857,996 A | * | 12/1974 | Hansen et al. | 174/113 R |
| 3,885,380 A | | 5/1975 | Hacker | 57/162 |
| 3,889,049 A | * | 6/1975 | Legg et al. | 174/102 R |
| 4,118,593 A | * | 10/1978 | Borroni | 174/26 R |
| 4,210,012 A | * | 7/1980 | Dameron, Jr. et al. | 57/9 |
| 4,218,577 A | * | 8/1980 | Bahder et al. | 174/23 C |
| 4,538,022 A | * | 8/1985 | Barnicol-Ottler et al. | 174/113 R |
| 4,629,285 A | | 12/1986 | Carter et al. | 350/96.23 |

(List continued on next page.)

FOREIGN PATENT DOCUMENTS

| | | | |
|---|---|---|---|
| DE | 32 24 595 A1 | 6/1982 | H01B/7/28 |
| EP | 0 342 149 A1 | 5/1989 | H01B/7/28 |
| FR | 1 088 108 A | 3/1955 | 12/6 |
| GB | 2 168 824 A | 9/1985 | H01B/11/22 |

OTHER PUBLICATIONS

PCT International Search Report for PCT/US01/15430, mailed Nov. 9, 2001.

Madison Cable Corporation, Spec #14188, Part No. 08LF100090, dated Mar. 12, 1998, p. 1 of 1.

Madison Cable Corporation, Spec #15315, dated May 19, 1999, p. 1 of 1.

Madison Cable Corporation, Spec #100–2191, Part No. 042FA00002, dated Jan. 20, 2000, p. 1 of 1.

Madison Cable Corporation, Spec #100–2192, Part No. 042GA00005, dated Jan. 20, 2000, p. 1 of 1.

*Primary Examiner*—Dean A. Reichard
*Assistant Examiner*—William H. Mayo, III

(57) ABSTRACT

A quad cable construction and a method of manufacturing the same are provided for use in communications for a local area network, while offering significant vapor migration and petroleum immersion resistance characteristics. A cable is provided with inner and outer jackets encompassing a helix configuration of insulated signal conductors. A core filler is provided to substantially fill the core and interstices between the insulated signal conductors. The core filler and inner jacket are formed of vapor proof material and bound with the insulated signal conductors in a manner that substantially fills all grooves and crevices around the insulated signal conductors to substantially prevent vapor migration along the cable length. An outer jacket may be provided that is impervious to gas, thereby permitting the cable to be submerged in petroleum for extended periods of time without affecting operation.

30 Claims, 3 Drawing Sheets

U.S. PATENT DOCUMENTS 4,755,629 A 7/1988 Beggs et al. ..... 174/34
4,781,433 A * 11/1988 Arroyo et al. ..... 350/96.23
4,893,665 A * 1/1990 Reuter et al. ..... 152/451
4,993,804 A * 2/1991 Mayr et al. ..... 350/96.23
5,082,995 A * 1/1992 Paterson et al. ..... 174/113 R
5,247,599 A * 9/1993 Vyas et al. ..... 385/113
5,342,686 A * 8/1994 Guersen et al. ..... 428/378
5,389,442 A * 2/1995 Arroyo et al. ..... 428/396
5,422,973 A * 6/1995 Ferguson et al. ..... 385/112
5,521,333 A 5/1996 Kobayashi et al. ..... 174/113 R
5,574,250 A * 11/1996 Hardie et al. ..... 174/36
5,777,273 A * 7/1998 Woody et al. ..... 174/113 R
5,789,711 A * 8/1998 Gaeris et al. ..... 174/113 C
5,883,334 A * 3/1999 Newmoyer et al. ..... 174/113 R
5,969,295 A * 10/1999 Boucino et al. ..... 174/113 C
6,010,788 A * 1/2000 Kebabjian et al. ..... 428/381
6,205,277 B1 * 3/2001 Mathis et al. ..... 385/106
6,211,467 B1 * 4/2001 Berelsman et al. ..... 174/113 R

* cited by examiner

VAPOR PROOF HIGH SPEED COMMUNICATIONS CABLE AND METHOD OF MANUFACTURING THE SAME

BACKGROUND OF THE INVENTION

1. Field of the Invention

The preferred embodiments of the present invention generally relate to communications and electronics cabling, and in particular to a vapor proof cable, such as for high speed communications and network interconnect cable, and a method of manufacturing the same.

2. Background Art

Communications and electronics cables are used today in a broad array of applications, many of which require that the cable carry high frequency signals over long distances. The operating frequency range for modem cable is significantly higher than the range needed for past applications, due in part to the evolution of communications and electronics equipment. In addition, today's applications require that cable operate under environmental conditions that are significantly more demanding than in the past.

Communications and electronics applications have been proposed that require cables capable of supporting ethernet protocols, while submerged for extended periods of time in fluid, such as oil, gas, water and the like. In at least one application, networking cables are installed at gasoline service stations to interconnect fuel pump electronics and point of sale (POS) equipment. The point of sale equipment communicates with the fuel pump via an ethernet data transmission protocol, such as established in accordance with the IEEE 802.3 10Base-T standard. Interconnect cable used in service station applications is exposed to petroleum fumes and, in some instances, may be submerged in fuel. Other protocols that cable can be used for include asynchronous transfer mode communication.

Heretofore, local area networks, such as used at service stations, typically use category 5 cable as the interconnect cable. Category 5 represents a standard set forth by ANSI, and the TIA/EIA group. Conventional category 5 cable includes twisted groups of insulated conductors. Each twisted group may include two or more conductors forming pairs. Twisted pair cable includes air gaps between an inner surface of the cable jacket and the twisted pair insulated conductors. Twisted pair cable also includes a hollow core between the multiple twisted pair insulated conductors within the cable. The air gaps and hollow core both facilitate the migration of fumes or vapors along the length of the cable. Hence, the potential exists that the cable may transport explosive vapors from the pump to the facility where the clerk is located.

In the past, attempts have been made to vapor proof category 5 cable in order to prevent fumes from migrating to the service station and to comply with safety regulations. One method in the past includes stripping away the cable jacket at multiple discrete regions along the length of the cable when the cable is installed to expose the insulated conductors. A potting material is applied to the conductors at each exposed area to form a vapor blocking seal. The potting material is applied at multiple discrete points along the length of the cable to provide a series of discrete or sectional vapor locks. Multiple vapor locks are necessary since the potting material may develop cracks or be improperly applied, thereby permitting vapor to enter the cable and migrate through a vapor lock. Also, the jacket may become damaged between the service station and any given vapor lock, thereby permitting vapor to enter the jacket and migrate toward the service station upstream of a vapor lock. The existing practice of stripping cables and adding potting material is labor intensive, expensive and unreliable and is undesirable.

FIG. 1 illustrates a category 5 cable that has been used for ATM and ethernet interconnections heretofore. The cable 10 includes a jacket 12 enclosing four twisted pairs 14–17 of conductors arranged in a helix configuration and surrounding a hollow core 18. The twisted pairs 14–17 contact one another and the inner surface 20 of the jacket 12. The relative positions of the twisted pairs 14–17 remain substantially constant with respect to one another. The twisted pairs 14–17 are also twisted to form one large helix. The outer boundary of each twisted pair 14–17 is denoted by dashed line 28. Do to the very nature of a helix, the cable 10 includes several peripheral air gaps 24–27 located between the inner surface 20 of the jacket 10 and the outer peripheral sections of the twisted pairs 14–17, and air gaps 38 within each twisted pair 14–17.

Each twisted pair 14–17 comprises two wires 30 and 32 enclosed in insulators 34 and 36, respectively. A rip cord (not shown) may be provided proximate the inner surface 20 of the jacket 12. The wires 30 and 32 are copper and the insulators 34 and 36 are formed of a polyolefin or fluoropolymer insulator. The jacket 12 is constructed of riser or plenum rated PVC or fluoropolymer.

The cable 10 is arranged in a specific geometry and constructed from materials having a set of desired electrical and physical properties that interact with one another in a particular manner. The overall geometric and material combination affords physical and electrical characteristics that satisfy the requirements of the category 5 standard. Therefore, the cable 10 is approved for use in telecommunications and electronics applications that require category 5 cable.

Air is provided in the cable 10 in the core 18 and gaps 24–27 and 38, to achieve specific electrical characteristics. The geometric configuration and dielectric constants for the materials used in the cable 10, along with the dielectric constant of air in the core 18 and in air gaps 24–27 and 38 interact to achieve a desired characteristic impedance and to minimize cross talk between signals transmitted over the twisted pairs 14–17, and interact to minimize attenuation and skew. Therefore, the inclusion of air in the cable 10 is necessary and desirable for category 5 cable. By way of example, the cable 10 exhibits standard electrical characteristics.

The cable 10 is able to meet the requirements of the TIA/EIA-568-A standard for the category 5 cable by including air around the insulated conductors 14–17.

In certain networking applications, data transmission protocols may be used that differ from the category 5 standard. For instance, in certain ethernet networks, data transmission protocols are used that meet a less strict standard, such as the 10Base-T standard. By way of example, the ethernet network used at service stations, such as in the example explained above, may utilize a data transmission protocol that satisfies the 10Base-T standard.

A need remains for an improved network cable that is vapor proof and gas impermeable, while continuing to offer the electrical characteristics needed for high speed data transmissions. It is believed that the preferred embodiments of the present invention, satisfy this need and overcome other disadvantages of conventional cabling which will become more readily apparent from the following discussion.

BRIEF SUMMARY OF THE INVENTION

In accordance with at least one preferred embodiment of the present invention, a quad cable is provided including a jacket and at least one quad of insulated signal conductors encased within the jacket. The insulated signal conductors contact one another and are arranged in a helix configuration defining a hollow core. A vapor proof filler substantially fills the hollow core. The jacket and filler fill the gaps and crevices around each insulated conductor to form a hermetic seal along the length of the insulated signal conductors, thereby preventing vapor migration along a length of the cable. In one embodiment, the jacket includes a gas impermeable outer jacket and an inner jacket, while in another embodiment the jacket includes a single unitary jacket. In both embodiments, the single jacket and inner jacket have a dielectric constant higher than a dielectric constant of the insulation on the insulated signal conductors to afford desirable electrical characteristics. The jacket constitutes a pressure extruded compound substantially filling interstices between the insulated signal conductors. The jacket may also include an outer nylon layer substantially impervious to gas. The vapor proof filler represents a pulled core expanded between the insulated signal conductors to substantially fill the hollow core and interstices between the insulated signal conductors. In accordance with one preferred embodiment, the pulled core is formed of cotton, and in an alternative embodiment, the pulled core is formed of an aramid yarn material.

According to an alternative embodiment of the present invention, a method of manufacturing a quad cable is provided. The manufacturing method includes the steps of arranging a quad of insulated signal conductors in a helix and in contact with one another. As the insulated signal conductors are arranged in a helix, they define a hollow core therebetween. The manufacturing method further includes introducing a vapor proof filler between the insulated signal conductors to substantially fill the hollow core and crevices between the insulated signal conductors, before the helix is finally formed. As the helix is formed, the insulated conductors are compressed around the core filler to form a hermetic seal with the inner periphery of the conductors. The method further includes applying a pressure extrudable compound around the outer periphery of the insulated signal conductors as a single or inner jacket. The introducing and applying steps form a seal between the insulated signal conductors, filler and jacket substantially void of air gaps to prevent vapor migration along the length of the insulated signal conductors.

In at least one alternative embodiment, an inner jacket is pressure extruded over the insulated signal conductors. The inner jacket has a dielectric constant higher than a dielectric constant of the insulation on the insulated signal conductors. The pressure extruding step surrounds the outer perimeter of the signal conductors to substantially fill the interstices between the insulated signal conductors with extruded material. The inner layer may be formed from a polyvinylchloride material. The inner jacket may be encased in a gas impermeable outer layer. The outer layer may be formed of a nylon material.

In one alternative embodiment, during the introducing step, the vapor filler is provided between the quad insulated signal conductors before the signal conductors are arranged in a helix and in contact with one another. The vapor proof filler constitutes a soft compressible core. Once the vapor proof filler is properly located between the quad conductors, the quad conductors are compressed and formed into a helix or vice versa. The compression operation causes the vapor proof filler to expand into the grooves between the conductors.

BRIEF DESCRIPTION OF THE DRAWINGS

The foregoing summary, as well as the following detailed description of the preferred embodiments of the present invention, will be better understood when read in conjunction with the appended drawings. For the purpose of illustration, the drawings show embodiments which are presently preferred. It should be understood, however, that the present invention is not limited to the precise arrangements, materials and instrumentality shown in the attached drawings.

FIG. 4 illustrates an enlarged cross-sectional view of a multiple differential pair category 5 cable formed in accordance with an alternative embodiment of the present invention.

DETAILED DESCRIPTION OF THE INVENTION

Figure 1:
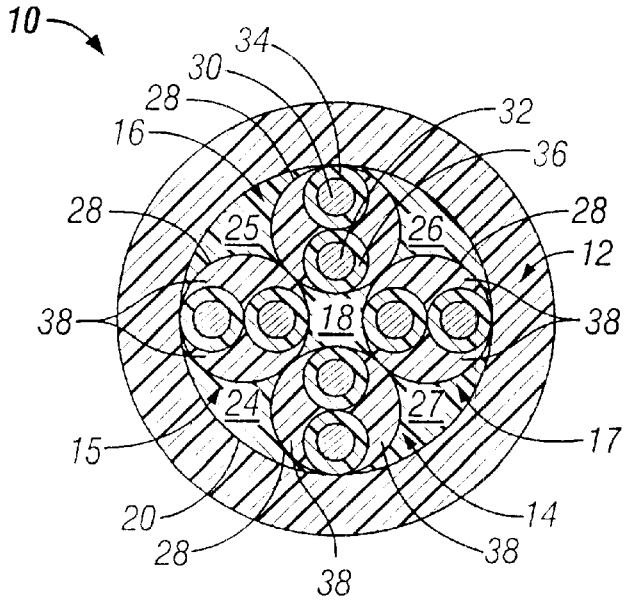
FIG. 1 (Prior Art)
FIG. 1 illustrates an enlarged cross-sectional view of a conventional multiple differential pair category 5 cable.
Figure 2:
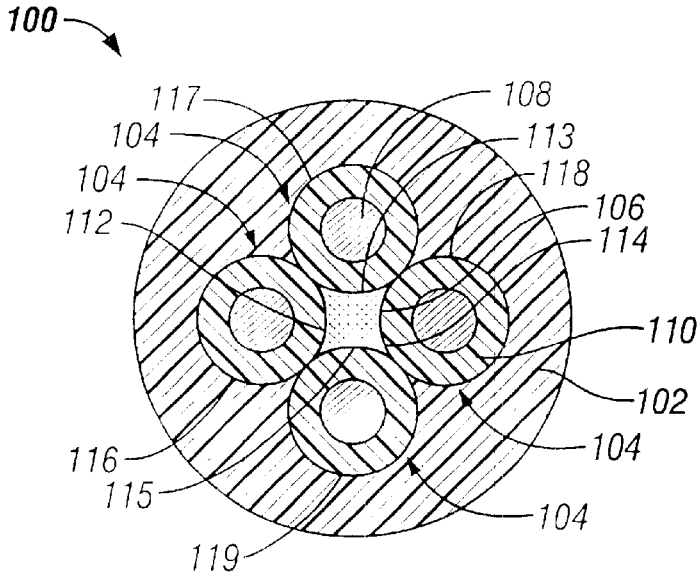
FIG. 2 illustrates an enlarged cross-sectional view of a quad cable formed in accordance with a preferred embodiment of the present invention.

FIG. 2 illustrates a preferred embodiment of the present invention including a cable 100 having a unitary single jacket 102 that encircles and encases two pair of insulated signal conductors 104. The insulated signal conductors are formed in a helix configuration and define a hollow core therebetween. The hollow core is substantially filled with a vapor proof material 106. The vapor proof material 106 extends along a length of the core defined by the conductors 104. Each conductor 104 includes a conductive center wire 108 surrounded by insulation 110. The wires 108 carry data transmissions, the characteristics of which are defined in accordance with an ethernet protocol, such as for local area networks complying with the 10Base-T standard, the 100Base-T standard, the ATM standard and the like. The signal conductors 104 carry high frequency transmissions at data rates of 10 Mbits per second, 100 Mbits per second and higher. By way of example only, the cable 100 may carry ethernet data transmissions, such as utilized at a service station for providing an interconnection between fuel pump electronics and service station equipment. The vapor proof material 106 forms a hermetic seal with inner peripheral segments 112–115 of the insulated signal conductors 104. The segments 112–115 extend along a length of the insulated signal conductors 104. The unitary single jacket 102 forms a hermetic seal with the outer peripheral segments 116–119 of the insulated signal conductors 104. The segments 116–119 extend along a length of the insulated signal conductors 104.

By way of example only, the cable 100 may be constructed with conductors 104 including two pair of solid tin plated copper having a diameter of approximately 0.0253 inches. The insulation may be 0.0083 inches in thickness and constructed of FEP material. The insulation 110 may have an outer diameter of 0.042 inches. The vapor proof material 106 may be formed of cotton or an aramid yarn type material. The jacket 102 may have an outer diameter of 0.025 inches and may be formed of pressure extruded gasoline resistant Polyurethane. The outer diameter of the cable 100 may be approximately 0.190 inches nominally. A cable 100 having the above-exemplary dimensions and materials satisfies certain standards for supporting data transmission in accordance with an ethernet protocol, such as for a local area network.

The dimensions, geometry and materials used in cable 100 are configured in order to achieve desired electrical characteristics, such as for impedance, signal attenuation, skew, capacitance and the like. The insulated signal conductors 104 are formed into a helix or twisted configuration in order to provide uniform transmission characteristics, physical robustness, and protection from electromagnetic interference. The dielectric constants for the vapor proof material 106 and jacket 102 are chosen to be higher than the dielectric constant for the insulation 110 to achieve the desired affective dielectric constant between diametrically opposing conductors that form the differential pair. The outer diameters for the wire 108, insulation 110 and jacket 102 are controlled to maintain an impedance for the cable 100 within a desired range. In the embodiment of FIG. 2, the cable exhibits an impedance of approximately 100 ohms nominally by TDR or as measured by frequency domain network analysis over the range of 1–100 MHz. By way of example only, the cable 100 exhibits an unbalanced signal pair to ground capacitance of approximately 1,000 pF/1,000 ft. maximum at 1 kHz. By way of example only, the cable 100 experiences near end cross-talk (NEXT) and other electrical characteristics as set forth below in Table 1.

TABLE 1

| Frequency (MHz) | NEXT (dB Nominal) |
|---|---|
| 5.0 | 28 |
| 7.5 | 25 |
| 10.0 | 23 |
| Dielectric Withstand: | 2500 Vdc For 3 seconds |
| Conductor DC Resistance: | 28.6 Ohms/1000 ft. Maximum @ 20° C. |
| Conductor DC Resistance Unbalance: | 5% Maximum |

Figure 3:
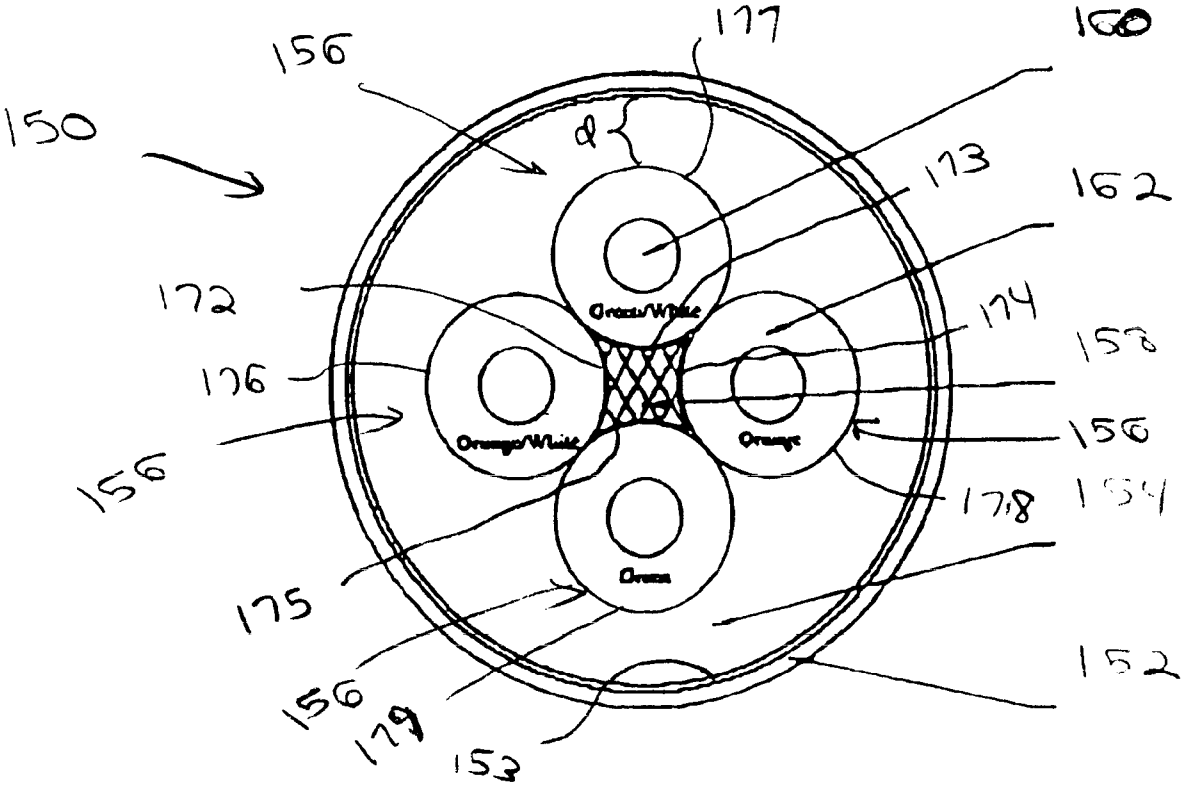
FIG. 3 illustrates an enlarged cross-sectional view of a quad cable formed in accordance with an alternative embodiment of the present invention.
Figure 8:
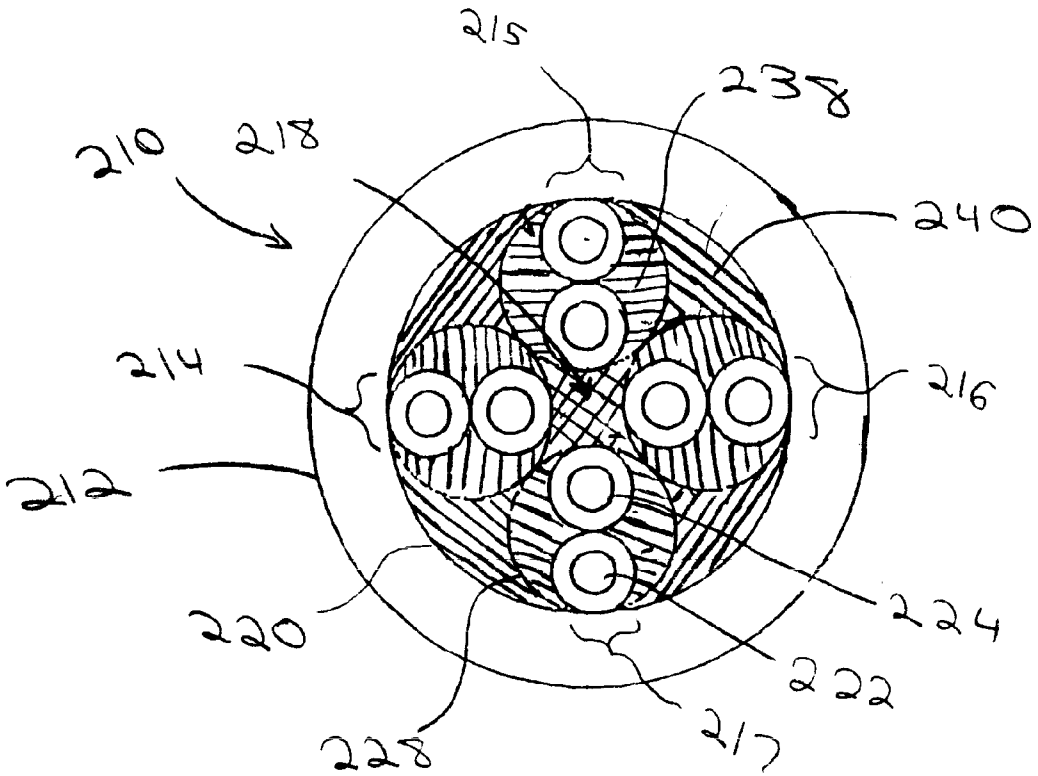

FIG. 3 illustrates an alternative preferred embodiment for a cable 150 including an outer jacket 152 and an inner jacket 154. The inner jacket 154 surrounds and hermetically encases a quad configuration of insulated signal conductors 156 that define a hollow core therebetween. A core filler 158 is provided between the insulated signal conductors 156. The core filler 158 substantially fills the grooves or interstices between the insulated signal conductors 156. Each insulated signal conductor 156 comprises a wire 160 surrounded by insulation 162. The core filler 158 is formed of a compressible filament, such as cotton, an aramid yarn and any similar material that exhibits significant vapor blocking characteristics. When the core filler 158 is formed of an aramid yarn material, the core filler 158 also provides added strength to the overall structure of the cable 150. The inner jacket 154 is pressure extruded around the insulated signal conductors 156. The inner jacket 154 is formed of a pressure extrudable polyvinylchloride (PVC) material. The outer jacket 152 may be formed of nylon or a similar material that is resistant or impervious to gas and oil (e.g., does not absorb or swell). The core filler 158 forms a hermetic seal with inner peripheral segments 172–175 of the insulated signal conductors 156. The segments 172–175 extend along a length of the insulated signal conductors 156. The inner jacket 154 forms a hermetic seal with the outer peripheral segments 176–179 of the insulated signal conductors 156. The segments 176–179 extend along a length of the insulated signal conductors 156.

When the outer jacket 152 is formed of nylon or another material having a dielectric constant higher than that of the insulation 162, the inner jacket 154 should be constructed with sufficient outer diameter to space the inner diameter 153 of the outer jacket 152 sufficiently far from the insulated signal conductors 156 to prevent the outer jacket 152 from unduly adversely affecting the electrical characteristics of the cable 150. Nylon typically has a high dielectric constant relative to the dielectric constant of insulation 162. Also, the dielectric constant of nylon and PVC may change based upon the frequency of transmission signals to which the nylon and PVC are exposed. Thus, when cable 150 is used in ethernet data transmissions carrying high frequency signals, the data signals may influence the dielectric constant of the nylon in the outer jacket 152, if the outer jacket is located too closely to the insulated signal conductors 156. Changes in a dielectric constant cause changes in attenuation, impedance, capacitance, etc., which cause reflection losses contributing to signal distortion and increased bit error rates. By way of example only, the inner jacket 154 may have a thickness sufficient to space the inner diameter 153 of the outer jacket a distance d from the insulated signal conductors 156.

The inner jacket 154 is formed of PVC which has a higher dielectric constant than that of the insulated signal conductors 156. The FEP insulation 162 exhibits a stable dielectric constant that remains constant regardless of the frequency of the transmitted signal. Consequently, the insulation 110 affords impedance matching, low capacitance and other desired electrical characteristics.

The cable 150, as configured with the above described geometry, materials and dimensions, satisfies at least the 10Base-T standard for transmitting ethernet data communications. It is understood that the geometry, materials and dimensions may be varied within a range and still satisfy the 10Base-T standard. The cable 150 is capable of meeting the vapor test defined by UL standard 87, section 36A, paragraph 22.17. The outer jacket 154 is capable of meeting the requirements of the UL standard, subject 758 gas and oil immersion test.

By way of example only, the wires 160 may be solid tin plated copper with an inner diameter of approximately 0.0253 inches or 0.024 inches. The insulation 162 may include a thickness of 0.0083 inches and be made of FEP, PFA, polyolefin or other low dielectric materials, thereby forming insulated signal conductors 156 with outer diameters of 0.042 and 0.037 inches, respectively. By way of example only, the inner jacket 154 may include an outer diameter sufficient to maintain a distance d between the insulated signal conductors 156 and the outer jacket 152 of approximately 0.020 inches. The inner jacket 154 may be formed of pressure extruded polyvinylchloride component. The outer jacket 152 may be formed with a thickness of 0.005 inches and may be constructed from nylon material. The foregoing dimensions for the exemplary cable 150 provide an outer diameter of 0.155 inches for a cable including 22 gauge conductors and an outer diameter of 0.140 inches for a cable including 24 gauge conductors. The cable 150 provides the electrical characteristics as set forth below in Table 2.

TABLE 2

| | |
|---|---|
| Differential Impedance: | 100 Ohms Nominal @ TDR |
| Pair-to-Ground Capacitance Unbalance: | 1000 pF/1000 ft. Maximum @ 1 kHz |
| Frequency (MHz) | NEXT (dB Nominal) |
| 5.0 | 28 |
| 7.5 | 25 |
| 10.0 | 23 |
| Dielectric Withstand: | 2500 Volts DC For 3 Seconds |
| Conductor DC Resistance: | 28.6 Ohms/1000 ft Maximum @ 10° C. |
| Conductor DC Resistance Unbalance: | 5% Maximum |

The cables 100 and 150 in FIGS. 2 and 3 may be manufactured in accordance with an alternative embodiment as set forth hereafter. Initially, the four signal conductors 104, 156 and a compressible vapor blocking material 106 or core filler 158 are simultaneously pulled through a quad forming tool. The quad forming tool presses the conductors 104, 156 against one another and against the vapor blocking material 106 or core filler 158, while simultaneously twisting the conductors 104, 156 into a helix or quad configuration. As the conductors 104, 156 are pressed together, the vapor blocking material 106 or core filler 158 is remolded or shaped to pervade into the crevices and cracks between the conductors 104, 156, and form a hermetic seal with inner and outer peripheral segments 112–115, 172–175, and 116–119, 176–179.

Next, a plastic compound is pressure extruded around the conductors 104, 156 to form the single jacket 102 or inner jacket 154. The pressure extruding process forces the plastic compound into the interstices between and surrounding the conductors 104, 156. The thickness of the insulation 110, 162 and the dimensions of the single jacket 102 or inner jacket 154 are controlled to ensure that the overall combination exhibits the desired electrical characteristics. The vapor proof material 106 or core filler 158 subsequently fills all voids within and along the length of the cable 100, 150.

It is understood that the above specific dimensions and particular materials are not required to practice the preferred embodiments of the present invention. Instead, a range of material qualities and dimensions for the various components may be utilized, while still enjoying the advantages and benefits offered by the preferred embodiments of the present invention. By way of example, the following Table 3 sets forth exemplary ranges for the materials used in accordance with the preferred embodiments of FIG. 3.

TABLE 3

| | Preferred Dielectric Constant Value | Optimal Dielectric Constant Range | Acceptable Dielectric Constant Range |
|---|---|---|---|
| Insulation | 2.01 | 1.8–2.2 | 1.5–2.9 |
| Inner Jacket | 4.2 | 3.9–4.5 | 2.3–6.1 |
| Outer Jacket | 3.50 | 3.0–4.0 | 2.0–5.0 |

The dielectric constant ranges provided in Table 3 are by way of example only and for use with the exemplary materials and dimensions set forth above in connection with FIGS. 2 and 3. It is understood that the ranges for preferable, optimal and acceptable dielectric constants will vary with different materials and dimensions.

Optionally, the geometry, materials and dimensions of the cables 100 and 150 may be modified and altered to satisfy other communications and/or electronics standards, provided that such a modification still offers a vapor migration proof cable having desirable electrical characteristics for transmission of high frequency signals.

FIG. 4 illustrates an alternative embodiment in accordance with the present invention. A cable 210 is provided for carrying communications transmissions, such as defined by the category 5 standard and the like. The cable 210 includes a jacket 212 enclosing multiple twisted pairs 212–217 of conductors arranged in a helix configuration. The insulated conductors 222 and 224 in each twisted pair 212–217 are twisted within an outer boundary defined by line 228. The twisted pairs 212–217 are then twisted to form one large helix. Each twisted pair 212–217 includes interstitial gaps within boundary 228. The interstitial gaps within each twisted pair 212–217 are filled with an intra-pair gap filler 238. Outer peripheral air gaps are provided between the boundaries 228 of adjacent twisted pairs 212–217 and the inner diameter 220 of the jacket 212. The peripheral gaps are filled with an inter-pair gap filler 240. The core is filled with a core filler 218.

The core filler 218, intra-pair gap filler 238, and inter-pair gap filler 240 cooperate to hermetically encase the insulated conductors 222 and 224 for each twisted pair 212–217. In the foregoing manner, substantially all air gaps are removed from within the jacket 212 along the length of the cable 210.

By way of example only, the intra-pair gap filler 238 for each twisted pair 212–217 may be formed from cotton, an aramid yarn and the like. Similarly, the core filler 218 may be formed of cotton, an aramid yarn and the like. The peripheral inter-pair gap fillers 240 may be formed from pressure extruded plastic compositions, such as PVC and the like. Optionally, a gas impervious jacket 212 may be included. Alternatively, the pressure extruded peripheral inter-pair gap fillers 240 may be expanded to entirely encase the twisted pairs 212–217, such as the inner jacket 156 illustrated in FIG. 3, with or without a thin outer jacket thereabout.

According to yet a further alternative embodiment, the number of twisted pairs 212–217 may be varied, to as few as one twisted pair or to more than four twisted pairs.

The cable 210 illustrated in FIG. 4 may be manufactured in a sequence of steps, whereby the individual twisted pairs 212–217 are separately, initially formed with aramid yarn pulled and twisted therewith to form each twisted pair 212–217 substantially encased within intra-pair gap fillers 238. As discussed above in connection with the embodiments of FIGS. 2 and 3, the intra-pair gap filler 238 may be formed of a compressible material, such that, as the insulated conductors 222 and 224 are twisted, the intra-pair gap filler 238 is compressed and molded to substantially fill interstices between the conductors 222 and 224.

Next, the twisted pairs 212–217 and encasing intra-pair gap filler 238 are pulled with core filler 218 and twisted to form the larger helix configuration comprised of the core filler 218, twisted pairs 212–217 and intra-pair gap fillers 238. As the twisted pairs 212–217 are twisted into a helix, the core filler 218 is compressed and molded to conform to and substantially fill the interstices between the intra-pair gap fillers 238. Thereafter, a plastic composition, such as PVC, may be pressure extruded over the twisted pairs 212–217 to form peripheral fillers 240 substantially filling the interstices between the outer peripheral portions of the intra-pair gap fillers 238 and the inner surface 220 of the jacket 212. Finally, the jacket 212 encloses the cable internal structure.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A vapor proof cable for carrying high speed data transmissions, the cable comprising:

at least two signal conductors twisted in a helix configuration;

a vapor proof pulled core filler pulled between said at least two signal conductors, said core filler being compressed and deformed to sealably fill at least internal interstices between said at least two signal conductors; and a vapor proof pressure extruded peripheral material filling peripheral interstices located about said at least two signal conductors, said pulled core filler and extruded peripheral filler hermetically encasing said at least two signal conductors along a length thereof to block vapor migration along the cable.

2. The cable of claim 1, further comprising:

a plurality of twisted pair signal conductors defining a hollow core between the twisted pairs and intra pair gaps within each twisted pair, said pulled core filler including a first strand of aramid yam substantially filling said hollow core and a second strand of aramid yam substantially filling said intra pair gaps.

3. The cable of claim 1, further comprising:

first and second pulled core fillers hermetically encasing said at least two signal conductors, said extruded peripheral material hermetically encasing said first and second pulled core fillers.

4. The cable of claim 1, further comprising:

a quad of twisted pair signal conductors formed in a helix defining a hollow core, intra pair gaps and inter pair gaps, said pulled core filler and peripheral material filling all air gaps in said hollow core, intra pair gaps and inter pair gaps.

5. The cable of claim 1, further comprising:

a quad of signal conductors.

6. The cable of claim 1, further comprising:

an inner jacket formed of said pressure extruded peripheral material; and an outer jacket substantially gas impervious.

7. A vapor proof cable comprising:

at least four insulated signal conductors twisted in a helix configuration and defining a hollow core, said at least four signal conductors having peripheral interstices thereabout;

a pulled core filler provided in said hollow core along a length of said at least four insulated signal conductors; and a peripheral material filling said peripheral interstices located about said at least four insulated signal conductors, said peripheral material hermetically encasing said at least four insulated signal conductors along a length thereof to block vapor migration along said peripheral interstices.

8. The vapor proof cable of claim 7 wherein said pulled core filler sealably engages said at least four insulated signal conductors and fills said hollow core along a length of said at least four insulated signal conductors to prevent vapors inside said peripheral material from migrating along said peripheral interstices.

9. The vapor proof cable of claim 7 wherein said pulled core filler forms a seal with inner interstices of said at least four insulated signal conductors preventing vapor migration along a length of said inner interstices of said at least four insulated signal conductors.

10. The vapor proof cable of claim 7 wherein said peripheral material includes inner and outer jackets, said inner jacket having a dielectric constant higher than a dielectric constant of insulation on said at least four insulated signal conductors.

11. The vapor proof cable of claim 7 further including a pressure extruded layer substantially filling interstices between said at least four insulated signal conductors, said pressure extruded layer sealably engaging said at least four insulated signal conductors.

12. The vapor proof cable of claim 7 further including a jacket, wherein said jacket constitutes a pressure extruded PVC inner jacket substantially filling interstices between said at least four insulated signal conductors.

13. The vapor proof cable of claim 7 further including a jacket, wherein said jacket includes an outer nylon layer substantially impervious to gas.

14. The vapor proof cable of claim 7 wherein said pulled core filler is compressed by said at least four insulated signal conductors and substantially filling interstices of said hollow core between said at least four insulated signal conductors.

15. The vapor proof cable of claim 7 wherein said pulled core filler constitutes a cotton core compressed by said at least four insulated signal conductors and filling interstices of said hollow core between said at least four insulated signal conductors.

16. The vapor proof cable of claim 7 wherein said pulled core filler constitutes an aramid yarn core compressed by said at least four insulated signal conductors and filling interstices of said hollow core between said at least four insulated signal conductors.

17. A method of manufacturing a cable, said method comprising:

arranging at least four insulated signal conductors in a helix configuration and in contact with one another, the at least four insulated signal conductors defining a hollow core, internal grooves between, and external grooves about, the at least four insulated signal conductors;

pulling a vapor proof filler between the at least four insulated signal conductors to substantially fill the hollow core and internal grooves along a length of the at least four insulated signal conductors; and filling the external grooves along the length of the at least four insulated signal conductors with a peripheral material, said pulling and filling steps encasing the at least four insulated signal conductors along a length thereof preventing vapor migration along the at least four insulated signal conductors.

18. The method of claim 17 further comprising hermetically encasing the at least four insulated signal conductors in a jacket, said filling step preventing vapors, which have entered an interior of the jacket, from migrating in the interior of the jacket along the length of the at least four insulated signal conductors.

19. The method of claim 17 further comprising pressure extruding a compound over the at least four insulated signal conductors to form an inner jacket, the inner jacket having a dielectric constant higher than a dielectric constant of insulation on the at least four insulated signal conductors.

20. The method of claim 17 further comprising pressure extruding an inner layer surrounding the at least four insulated signal conductors to fill the grooves between and about the at least four insulated signal conductors.

21. The method of claim 17 further comprising pressure extruding a PVC compound around the at least four insulated signal conductors to form an inner jacket to fill the grooves between and about the at least four insulated signal conductors.

22. The method of claim 17 further comprising adding an outer nylon jacket that is substantially impervious to gas.

23. The method of claim 17 wherein said pulling step includes pulling and compressing the at least four insulated signal conductors until the vapor proof filler fills the internal grooves between the at least four insulated signal conductors.

24. The method of claim 17 wherein said pulling step includes compressing the at least four insulated signal conductors until the vapor proof filler fills interstices between the at least four insulated signal conductors.

25. A method of manufacturing a cable, comprising:

twisting at least two insulated signal conductors in a helix configuration with outer segments of said at least two insulated signal conductors defining peripheral interstices;

pressure extruding a vapor proof peripheral material around said at least two insulated signal conductors and filling said peripheral interstices, said vapor proof peripheral material forming a seal with, and encasing, said outer segments; and enclosing said vapor proof peripheral material and said at least two insulated signal conductors in an outer jacket.

26. The method of claim 25 wherein said twisting step includes twisting at least four insulated signal conductors into said helix configuration with a hollow core, and further comprising pulling a compressible filament to fill said hollow core.

27. The method of claim 25 further comprising pulling a compressible filament into and filling inner interstices between said at least two insulated signal conductors to block vapor once entering the vapor proof peripheral material from migrating along a length of said inner interstices.

28. A vapor proof cable for carrying high speed date transmissions, the cable comprising:

at least two insulated signal conductors twisted in a helix configuration and having outer segments defining peripheral interstices about said at least two insulated signal conductors;

a vapor proof inner jacket filling said peripheral interstices about said at least two insulated signal conductors, said vapor proof inner jacket sealing with, and encasing, said outer segments of said at least two insulated signal conductors to block vapor migration along a length of said outer segments; and an outer jacket surrounding said vapor proof inner jacket.

29. The vapor proof cable of claim 28 wherein said at least two insulated signal conductors include at least four insulated signal conductors twisted in a helix configuration and defining a hollow core, and wherein a compressible filament core fills said hollow core.

30. The vapor proof cable of claim 28 wherein said at least two insulated signal conductors includes at least four insulated signal conductors twisted in a helix configuration, wherein said at least four insulated signal conductors have inner segments defining inner interstices, and wherein a compressible filament core fills said inner interstices to block vapor migration along a length of said inner segments.

* * * * *